US005544248A

United States Patent [19]

Date

[11] Patent Number: 5,544,248

[45] Date of Patent: Aug. 6, 1996

[54] AUDIO DATA FILE ANALYZER APPARATUS

[75] Inventor: Toshihiko Date, Yamatokouriyama, Japan

[73] Assignee: Matsushita Electric Industrial Co., Ltd., Osaka, Japan

[21] Appl. No.: 261,107

[22] Filed: Jun. 16, 1994

[30] Foreign Application Priority Data

Jun. 25, 1993 [JP] Japan ..... 5-154713

[51] Int. Cl.[6] ..... H04R 29/00

[52] U.S. Cl. ..... 381/56; 395/2.4; 395/2.85

[58] Field of Search ..... 381/56, 41, 42, 381/43, 48; 395/2.25, 2.55, 2.52, 2.6, 2.4, 2.85, 2.84

[56] References Cited

U.S. PATENT DOCUMENTS 4,985,924 1/1991 Matsuura ..... 381/43
5,148,484 9/1992 Kane et al. ..... 381/56

*Primary Examiner*—Scott A. Rogers
*Assistant Examiner*—Jerome Grant, II
*Attorney, Agent, or Firm*—Wenderoth, Lind & Ponack

[57] ABSTRACT

An audio data file analyzer apparatus includes: analyzers for analyzing at least one of physical characteristics of an audio signal to produce an analyzed resultant data the at least one physical characteristic possibly including a continuous time duration of the audio signal, a control data input for providing a control data for an audio data file; a reference code generator for producing a reference code from the analyzed resultant data and the control data; a reference code storage for storing the reference code; a reference code input for providing a specific reference code requested by an operator, and a reference code comparator for comparing the specific reference code, a newly introduced reference code which are produced by the reference code generator from other audio signal, or combination of the specific reference code and the newly introduced reference code with the reference code. Furthermore, while a multiplicity of the audio data files are stored in libraries controlled by a library controller, a new audio data file carrying desired physical characteristics can be produced from the audio data files of the libraries with an audio data processor.

17 Claims, 6 Drawing Sheets

FIG. 5

| | | 4 BYTES | | | | | | | |
|---|---|---|---|---|---|---|---|---|---|
| CONTROL DATA | FILE NAME | N | A | M | E | | | | |
| | | B | O | M | | | | | |
| | ADDRESS NAME | V | O | L | M | | | | |
| | | 1 | 3 | . | 2 | 5 | . | 0 | 1 |
| ANALYZED CHARACTERISTIC DATA | DURATION | T | I | M | E | | | | |
| | | 0.360 | | | | | | | |
| | STEADINESS OF LOUDNESS | T | C | N | T | | | | |
| | | 0.240 | | | | | | | |
| | STEADINESS OF TIMBRE | F | C | N | T | | | | |
| | | 1918.9 | | | | | | | |
| | TONE | C | E | P | T | | | | |
| | | 15.173 | | | | | | | |
| | BASS | L | O | W | R | | | | |
| | | 0.653 | | | | | | | |
| | MIDRANGE | M | I | D | R | | | | |
| | | 0.591 | | | | | | | |
| | TREBLE | H | I | G | H | | | | |
| | | 0.271 | | | | | | | |
| | NOISE | N | O | I | E | | | | |
| | | 0.595 | | | | | | | |

FIG. 6

| | | 4 BYTES | | | | | | | |
|---|---|---|---|---|---|---|---|---|---|
| CONTROL DATA | FILE NAME | N | A | M | E | | | | |
| | | B | O | M | | | | | |
| | ADDRESS NAME | V | O | L | M | | | | |
| | | 1 | 3 | . | 2 | 5 | . | 0 | 1 |
| ANALYZED RESULTANT DATA | DURATION | T | I | M | E | | | | |
| | | 0.360 | | | | | | | |
| | STEADINESS OF LOUDNESS | T | C | N | T | | | | |
| | | 0.240 | | | | | | | |
| | STEADINESS OF TIMBRE | F | C | N | T | | | | |
| | | 1918.9 | | | | | | | |
| | TONE | C | E | P | T | | | | |
| | | 15.173 | | | | | | | |
| | BASS | L | O | W | R | | | | |
| | | 0.653 | | | | | | | |
| | MIDRANGE | M | I | D | R | | | | |
| | | 0.591 | | | | | | | |
| | TREBLE | H | I | G | H | | | | |
| | | 0.271 | | | | | | | |
| | NOISE | N | O | I | E | | | | |
| | | 0.595 | | | | | | | |
| AUDIO DATA | | S | O | N | D | | | | |
| | | 32 | | | | | | | |
| | | -15 | | | | | | | |
| | | ⋮ | | | | | | | |
| | | 10 | | | | | | | |

AUDIO DATA FILE ANALYZER APPARATUS

BACKGROUND OF THE INVENTION

1. Field of the Invention

The present invention relates to an audio data file analyzer apparatus for handling audio data files comprising voices, tones, and sound effect used in an audio editing studio or the like.

2. Description of the Prior art

Sound materials including voices, tones, and sound effect to be used in an audio editing studio or the like are commonly stored on magnetic tapes or compact disks (referred to as CDs hereinafter) which serve as sound libraries. An operator retrieves-the sound materials by identifying the names of the sound materials.

However, there are at least hundreds or thousands of sound materials stored in the sound libraries of magnetic tapes or CDs. For optimum use of such large size sound libraries, the operator has to acknowledge all the names or contents of the sound materials. This requires particular skills and awesome training efforts.

Also, the names of the sound materials are too short or simple to explain various acoustic characteristics which the sound characteristics have. Hence, the sound material selected by the operator through judging from its name may be different from what the operator wanted.

SUMMARY OF THE INVENTION

It is an object of the present invention to provide an audio data file analyzer apparatus which allows the operator to correctly identify and select a desired sound material or audio data file from a large size library which contains too many sound materials to be identified by their names.

For achievement of the above object of the present invention, an audio data file analyzer apparatus comprises: a sound material input means for receiving an audio signal and producing an audio data file from the audio signal; an analyzing means for analyzing at least one of physical characteristics of the audio signal to produce analyzed resultant data; a control data input means for providing control data for the audio data file; a reference code generating means for producing a reference code from the analyzed resultant data and the control data; and a reference code storing means for storing the reference code.

Also, another audio data file analyzer apparatus according to the present invention comprises: a sound material input means for receiving an audio signal and producing an audio data file from the audio signal; an analyzing means for analyzing at least one of physical characteristics of the audio signal to produce analyzed resultant data; a control data input means for providing control data for the audio data file; a reference code generating means for producing a reference code from the analyzed resultant data and the control data; a reference code input means for providing a specific reference code requested by an operator; a reference code storing means for storing the reference code; and a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means.

In a recording mode, the reference code is stored in the reference code storing means and in a retrieval mode, a desired audio data file is retrieved by comparing the specific reference code, the newly introduced reference code, or combination of the specific reference code and the newly introduced reference code with the reference code stored in the reference code storing means.

BRIEF DESCRIPTION OF THE DRAWINGS

FIG. 5 is a diagram showing a data format of a reference code in the first embodiment; and FIG. 6 is a diagram showing a data format of an audio data file in the fourth embodiment.

DESCRIPTION OF THE PREFERRED EMBODIMENTS

Figure 1:
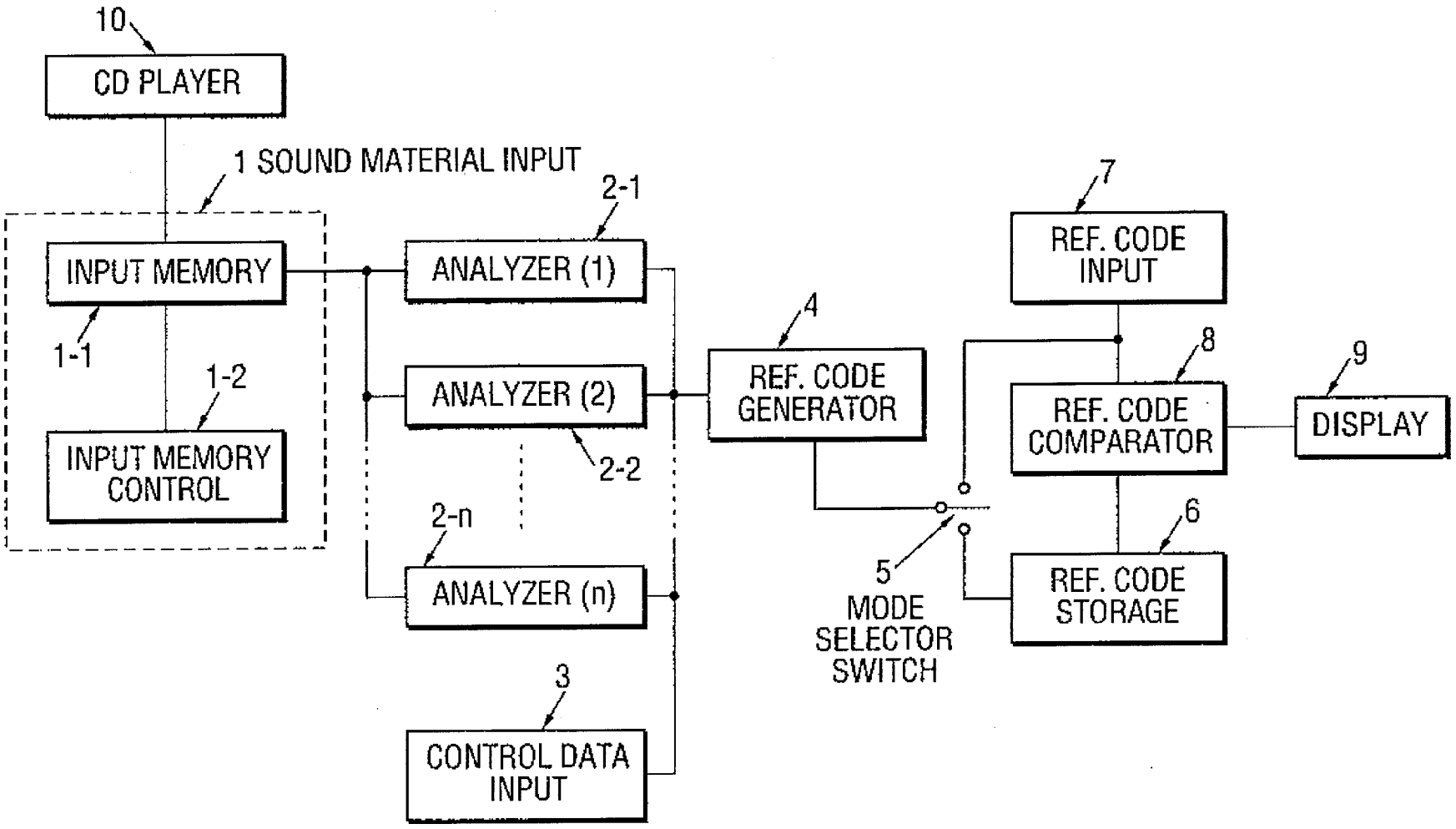
FIG. 1 is a block diagram of an audio data file analyzer apparatus of a first embodiment of the present invention.

FIG. 1 is a block diagram of an audio data file analyzer apparatus of a first embodiment of the present invention.

The operation of the audio data file analyzer apparatus is described below.

A variety of audio data including voices, tones, and sound effects are reproduced by a CD player 10 and supplied to an input memory 1-1 of a sound material input 1 for temporal storage. A desired piece of data is then extracted from the audio data stored in the input memory 1-1 and transmitted as an audio data file to a plurality of analyzers 2-1 to 2-n (n being a natural number). The audio data file can separately be produced by an operator or automatically constructed through editing sound materials and program control information recorded on a CD.

The audio data file is analyzed by the analyzers 2-1 to 2-n respectively for n different types of physical characteristics. The physical characteristics to be analyzed may include continuous time duration of audio data, frequency spectrum by FFT (Fast Fourier Transformation), level and quality of harmonics, acoustic continuation in decay time, steadiness of loudness and tone, tempo of music, and discrimination between voice and non-voice sound through LPC (Linear Prediction Coding). As each of the analyzers 2-1 to 2-n analyzes at least one of the physical characteristics, each of the physical characteristics which have been analyzed is fed to a reference code generator 4 as analyzed resultant data. Simultaneously, control data for identifying the audio data file, e.g. file names, are transferred from a control data input 3 to the reference code generator 4.

The control data may include a number of a disk or a tape, index items, and address or directory information of the sound material in a network, in addition to the file name.

In the reference code generator 4, a reference code is produced using the analyzed resultant data and the control data. An example of a data format of the reference code is shown in FIG. 5.

As shown in FIG. 5, the data format of the reference code carries at first a plurality of keywords such as NAME, VOLM, TIME, TCNT, etc. which represent the file name, address name, the continuous time duration, and the steadiness of loudness respectively and can be used for retrieval of the audio data file, and then carries data which correspond to each of the keywords. Each keyword in the data format of this embodiment consists of four letters (4 bytes) while the file or address name of the control data incorporates eight letters (8 bytes) and each item of the analyzed resultant data incorporates 4 bytes. Kinds and numbers of retrieving items may be determined depending on the audio data file but the keywords to be used for identical retrieving items should be identical throughout the audio data files. FIG. 5 illustrates two pieces of control data and eight of analyzed resultant data in one reference code.

For storing the reference code in a reference code storage 6, a mode selector switch 5 is shifted to a recording mode for connecting the reference code generator 4 to the reference code storage 6. Since the reference code contains no audio data, a recording medium for the reference code storage 6 may be a small-size recording medium such as a floppy disk.

For retrieval of a desired audio data file, the analyzed resultant data of a certain acoustic characteristic the audio data file as well as the control data such as the file name can be utilized. When the mode selector switch 5 is switched by the operator to a retrieval mode, the reference code is transmitted to a reference code comparator 8.

The reference code may be one carrying one or more desired acoustic characteristics and being entered directly through a reference code input 7, one produced with a combination of the analyzers 2-1 to 2-n and the reference code generator 4 from desired sound materials in the sound material input 1 which have physical characteristics similar to those required by the operator, or their combination.

The reference code comparator 8 compares a desired reference code with each of reference codes of the audio data files stored in the reference code storage 6 in a sequence and a name list of the audio data files containing the reference code which is the same as or similar to the desired reference code are displayed on a display 9.

According to the first embodiment of the present invention, while the audio data file is constructed from each of desired sound materials, the reference code is selectively produced from the control data and the analyzed resultant data determined by analyzing one or more physical characteristics of the audio data file. As the reference code is stored, any desired audio file which can hardly be specified by only a file name or other abstract control data can readily be obtained by retrieving desired audio data file by the reference code by explicitly reviewing desired physical characteristics of sound.

Figure 2:
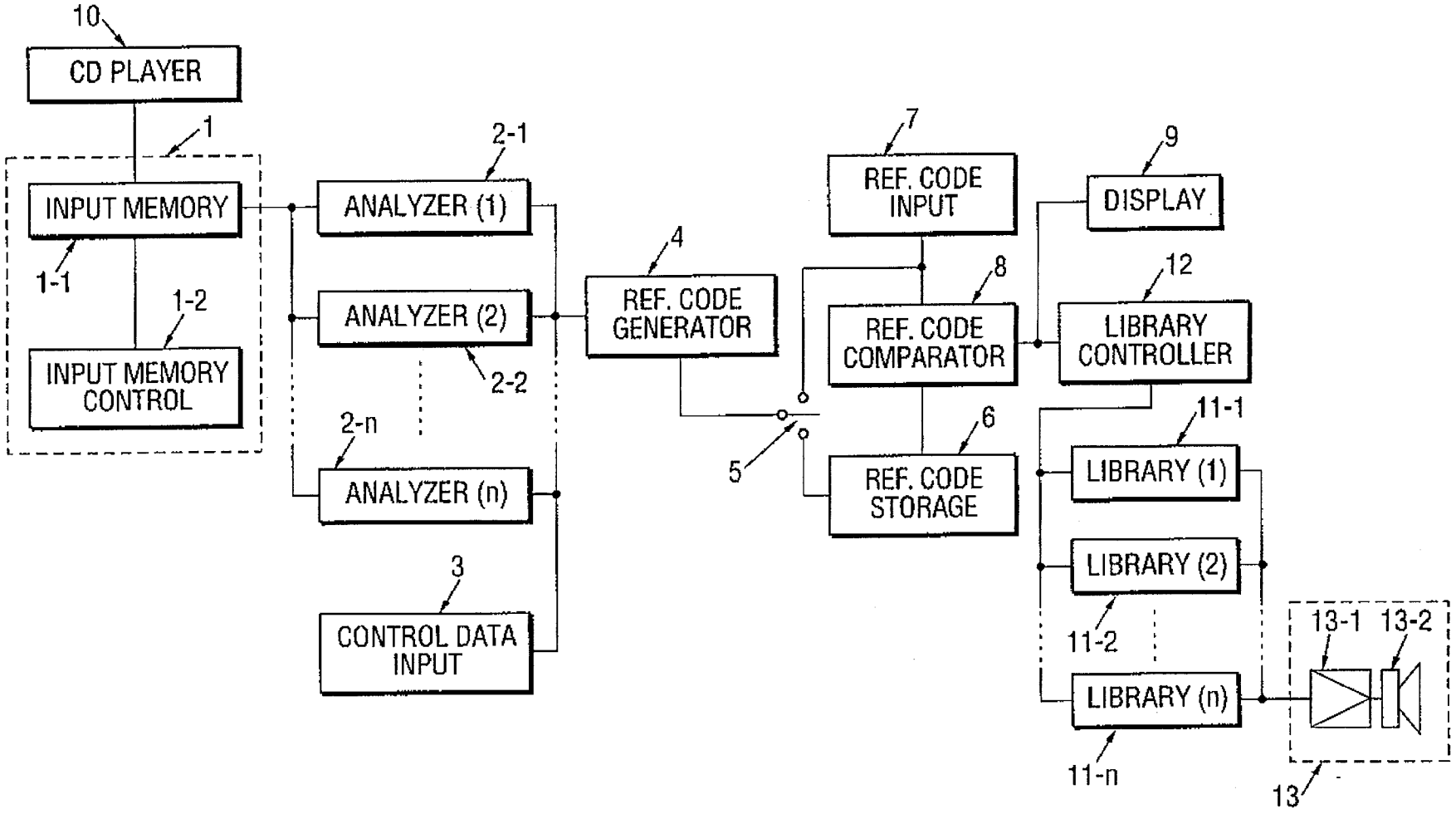
FIG. 2 is a block diagram of an audio data file analyzer apparatus of a second embodiment of the present invention.

FIG. 2 is a block diagram of an audio data file analyzer apparatus of a second embodiment of the present invention. Like components are denoted by the same numerals as those used in the first embodiment and will not be explained in detail. The second embodiment is different from the first embodiment in that there are a plurality of libraries 11-1 to 11-n, a library controller 12, and a reproducer 13 comprising an audio amplifier 13-1 and a loudspeaker 13-2.

Operation of the foregoing components in a combination is described as follows. In the recording mode, the sound materials reproduced by the CD player 10 are assembled into the audio data file which is then analyzed by the analyzers 2-1 to 2-n to generate the reference code. The reference code is stored in the reference code storage 6. Those steps are the same as in the first embodiment. In the retrieval mode, the desired audio data file can be retrieved by selecting its reference code with the reference code comparator 8 in the same manner as in the first embodiment. The libraries 11-1 to 11-n hold a plurality of audio data files whose physical characteristics have been analyzed by the analyzers 2-1 to 2-n and whose reference codes have been stored in the reference code storage 6.

In the retrieval mode of the second embodiment, while the desired audio data file is retrieved by selecting the reference code with the reference code comparator 8, the library controller 12 in response to the reference code comparator 8 causes the libraries 11-1 to 11-n to release the audio data file. The audio data file is transferred to the reproducer 13 for reproduction of the sound materials of the audio data file.

According to this embodiment, the audio data file determined by the reference code comparator 8 is released from the library by the action of the library controller 12. More particularly, any desired audio data file is not only retrieved using its reference code but also outputted automatically. Also, the sound materials in the audio data file can automatically be reproduced by the reproducer 13.

One or more of the libraries may be provided. External libraries such as those connected in a network may also be used with equal success in addition to the internal libraries installed in the audio data file analyzer apparatus.

Figure 3:
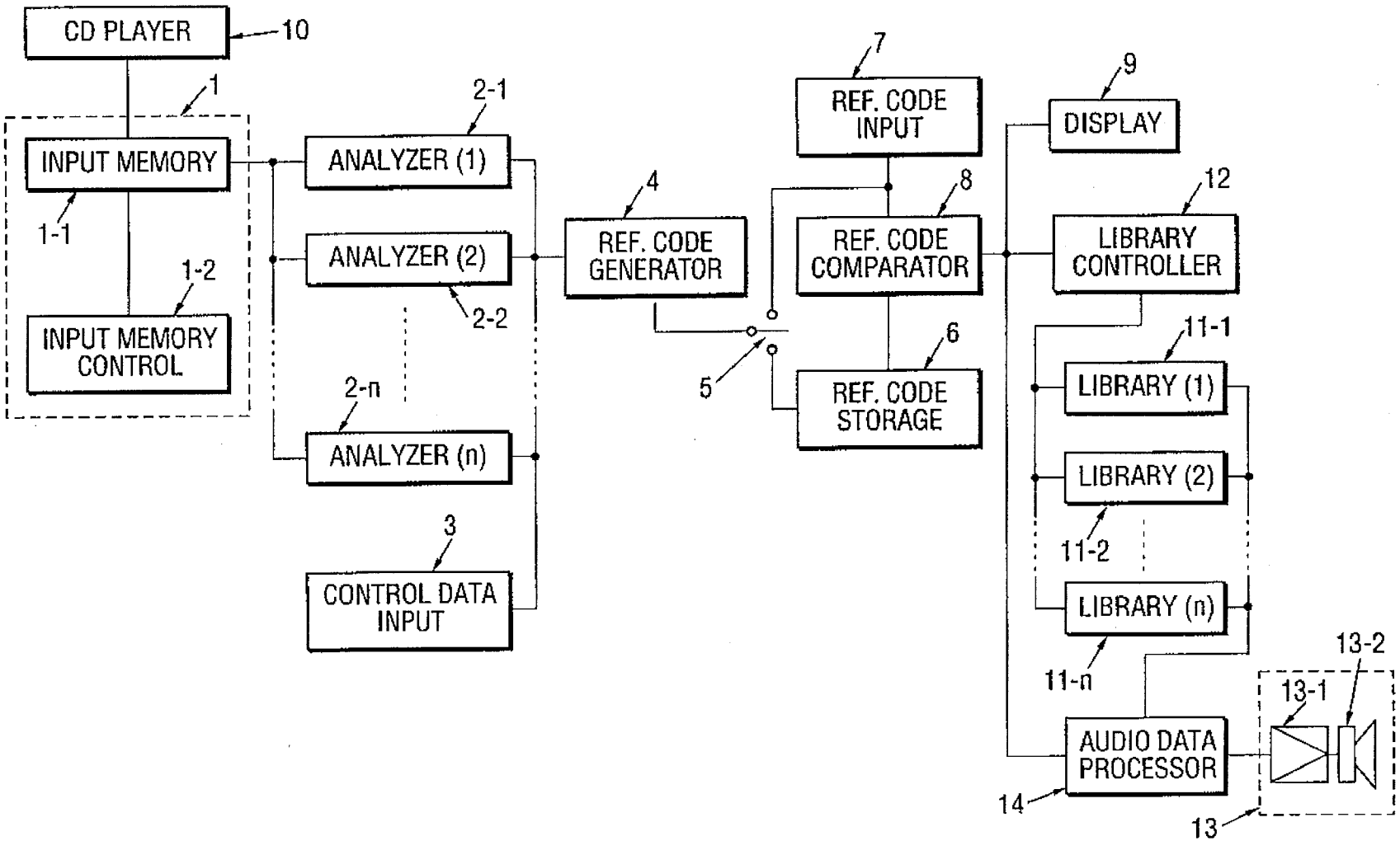
FIG. 3 is a block diagram of an audio data file analyzer apparatus of a third embodiment of the present invention.

FIG. 3 is a block diagram of an audio data file analyzer apparatus of a third embodiment of the present invention. Like components are denoted by the same numerals as those used in the second embodiment and will not be explained in detail. The third embodiment is different from the second embodiment in that there is an audio data processor 14 for modifying the physical characteristics of the audio data file to desired forms.

The operation of the third embodiment is described below. Actions in recording and retrieval modes where the desired audio data file is retrieved and reproduced are identical to those of the second embodiment.

In the retrieval mode of the this embodiment, if any physical characteristic of the audio data file selected and retrieved is undesirable (as visually monitored on the display 9), it can be modified to a desired physical characteristic by the audio data processor 14 before delivery to the reproducer 13. For example, if the continuous time duration of the physical characteristics of the audio data file is not accepted during retrieving, it can be changed to a desired continuous time duration by expansion or compression of the audio data file in the timebase. This modification allows the audio data file to be converted to a desired audio data file which is not found in the libraries 11-1 to 11-n by modifying a part of its physical characteristics. Such a physical characteristic modification will also be applicable to equalizing in the frequency spectrum or shifting the pitch of a frequency of the fundamental wave.

According to the third embodiment, the audio data processor 14 which can modify the physical characteristics of the audio data files stored in the libraries allows one-O to provide the sound materials having desired physical characteristics which are not identical to the physical characteristics of the audio data file. This is equivalent to a substantial increase in the kinds of audio data files stored in the libraries.

Figure 4:
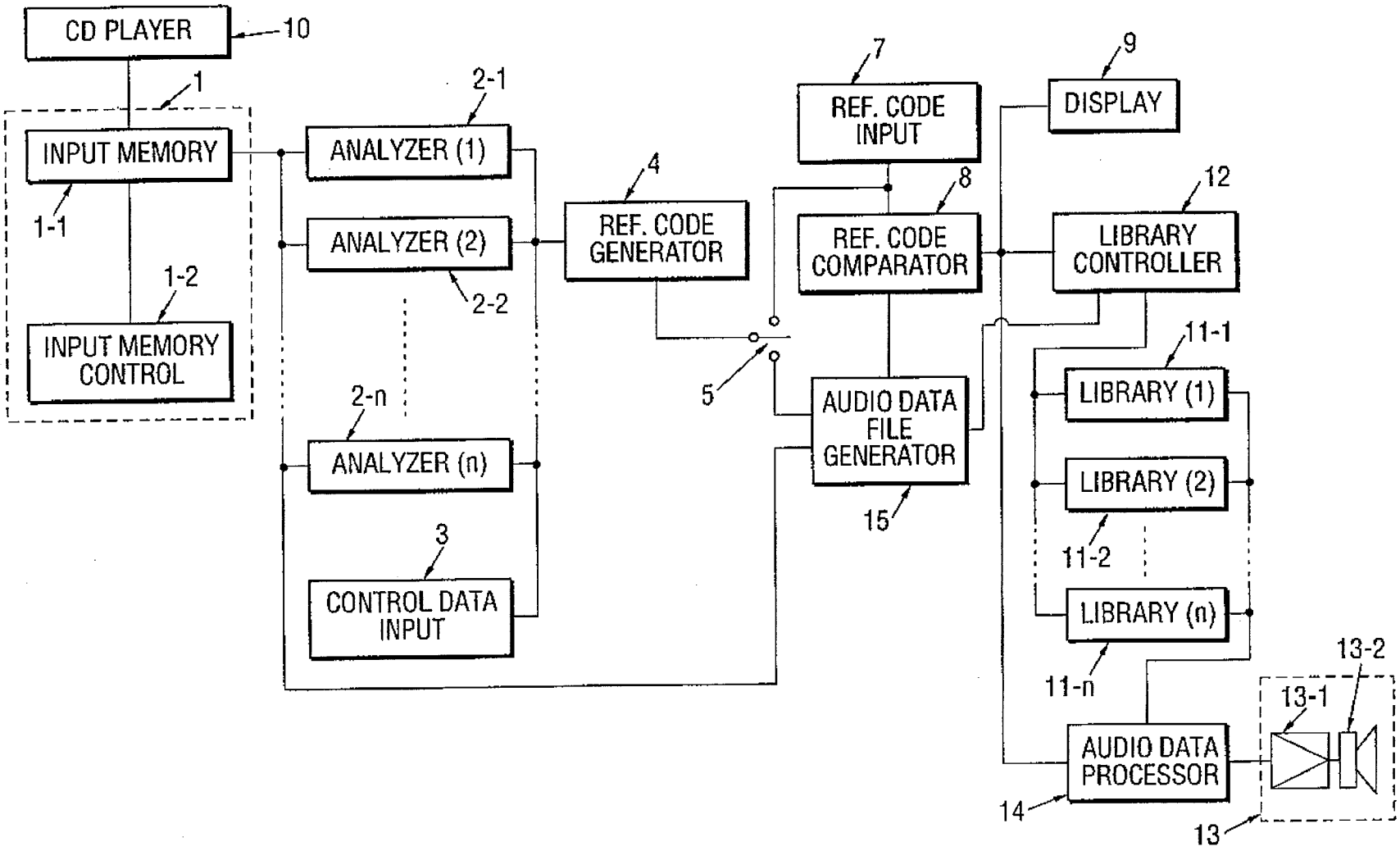
FIG. 4 is a block diagram of an audio data file analyzer apparatus of a fourth embodiment of the present invention.

FIG. 4 is a block diagram of an audio data file analyzer apparatus of a fourth embodiment of the present invention. Like components are denoted by the same numerals as those used the third embodiment and will not be explained in detail. The fourth embodiment is different from the third embodiment that the reference code storage 6 is eliminated and an audio data file generator 15 is added for producing a composite audio data file from the reference code and input audio data.

The operation of the fourth embodiment is described below.

In the recording mode of the this embodiment, the reference code from the reference code generator 4 and the audio data file from the sound material input 1 are loaded into the audio data file generator 15 where they are combined to produce the composite audio data file.

An example data format of such the composite audio data file according to the fourth embodiment is illustrated in FIG. 6. As shown, the reference code similar to shown in FIG. 5 is associated with the audio data file where its keyword "SOND" in the preamble is followed by audio data of 2 bytes per sample.

The composite audio data files each containing the reference code are then stored in the libraries 11-1 to 11-n by the library controller 12.

In the retrieval mode of this embodiment, any desired composite audio data file can directly be retrieved by the reference code in the libraries.

According to the fourth embodiment, a data base of audio data comprising the composite audio data files each containing the reference code can be constructed automatically.

What is claimed is:

1. An audio data file analyzer apparatus comprising:

a sound material input means for receiving an audio signal and producing an audio data file from the audio signal;

analyzing means for analyzing at least one of physical characteristics of the audio signal to produce an analyzed resultant data, said at least one of physical characteristics including a continuous time duration of the audio signal;

a control data input means for providing a control data for the audio data file;

a reference code generating means for producing a reference code from the analyzed resultant data and the control data; and a reference code storing means for storing the reference code.

2. An audio data file analyzer apparatus for retrieving a desired audio data file, said apparatus comprising:

a sound material input means for receiving an audio signal and producing an audio data file form the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

a reference code storing means for storing the reference code; and a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means.

3. An audio data file analyzer apparatus according to claim 2, wherein at least one physical characteristic includes a continuous time duration of the audio signal.

4. An audio data file analyzer apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

a reference code storing means for storing the reference code;

a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means;

a mode selecting means for switching between a recording mode and a retrieval mode; and a displaying means for displaying a result of the reference code comparing means, wherein in the recording mode, the reference code is stored in the reference code storing means and in the retrieval mode, a desired audio data file is retrieved by comparing the specific reference code, the newly introduced reference code, or combination of the specific reference code and the newly introduced reference code with the reference code stored in the reference code storing means.

5. An audio data file analyzer apparatus according to claim 4, wherein at least one physical characteristic includes a continuous time duration of the audio signal.

6. An audio data file analyzer apparatus for retrieving a desired audio data file, said apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

a reference code storing means for storing the reference code;

a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means;

library means for storing a multiplicity of audio data files;

a library controlling means for controlling the library means; and a reproducing means for reproducing the desired audio data file of the multiplicity of audio data files.

7. An audio data file analyzer apparatus according to claim 6, wherein at least one physical characteristic includes a continuous time duration of the audio signal.

8. An audio data file analyzer apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

a reference code storing means for storing the reference code;

a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means;

a mode selecting means for switching between a recording mode and a retrieval mode;

a displaying means for displaying a result of the reference code comparing means;

library means for storing a multiplicity of audio data files;

a library controlling means for controlling the library means; and a reproducing means for reproducing a desired audio data file of the multiplicity of audio data files, wherein in the recording mode, the reference code is stored in the reference code storing means and in the retrieval mode, the desired audio data file is retrieved by comparing the specific reference code, the newly introduced reference code, or combination of the specific reference code and the newly introduced reference code with the reference code stored in the reference code storing means.

9. An audio data file analyzer apparatus according to claim 8, wherein at least one physical characteristic includes a continuous time duration of the audio signal.

10. An audio data file analyzer apparatus for retrieving a desired audio data file, said apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

a reference code storing means for storing the reference code;

a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means;

library means for storing a multiplicity of audio data files;

a library controlling means for controlling the library means;

an audio data processing means for changing at least one of the physical characteristics of the audio signal to a desired physical characteristic if any of the physical characteristics of the audio signal are unretrieved and outputting the desired physical characteristic; and a reproducing means for reproducing the desired audio data file.

11. An audio data file analyzer apparatus according to claim 10, wherein at least one physical characteristic includes a continuous time duration of the audio signal.

12. An audio data file analyzer apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

a reference code storing means for storing the reference code;

a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means;

a mode selecting means for switching between a recording mode and a retrieval mode;

a displaying means for displaying a result of the reference code comparing means;

library means for storing a multiplicity of audio data files;

a library controlling means for controlling the library means;

an audio data processing means for changing at least one of the physical characteristics of the audio signal to a desired physical characteristic if any of the physical characteristics of the audio signal are unretrieved and outputting the desired physical characteristic; and a reproducing means for reproducing a desired audio data file, wherein in the recording mode, the reference code is stored in the reference code storing means and in the retrieval mode, the desired audio data file is retrieved by comparing the specific reference code, the newly introduced reference code, or combination of the specific reference code and the newly introduced reference code with the reference code stored in the reference code storing means, and by changing at least one of the physical characteristics of the audio signal to the desired physical characteristic if any of the physical characteristics of the audio signals are unretrieved.

13. An audio data file analyzer apparatus according to claim 12, wherein at least one physical characteristic includes a continuous time duration of the audio signal.

14. An audio data file analyzer apparatus for retrieving a desired audio data file, said apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

an audio data file generating means for combining the reference code and the audio data file to produce a composite audio data file;

a reference code comparing means for comparing the specific reference code, a newly introduced reference code, or combination of the specific reference code and the newly introduced reference code with the reference code, the newly introduced reference code being produced by the reference code generating means from other audio signal fed to the sound material input means;

library means for storing the composite audio data file;

a library controlling means for controlling the library means;

an audio data processing means for changing at least one of the physical characteristics of the audio signal to a desired physical characteristic if any of the physical characteristics of the audio signal are retrieved and outputting the desired physical characteristic; and a reproducing means for reproducing the desired audio data file.

15. An audio data file analyzer apparatus according to claim 14, wherein at least one physical characteristic includes a continuous time duration of the audio signal.

16. An audio data file analyzer apparatus comprising:

a sound material input means for receiving an audio signal and producing an audio data file from the audio signal;

analyzing means for analyzing at least one of physical characteristics of the audio signal to produce an analyzed resultant data;

a control data input means for providing a control data for the audio data file;

a reference code generating means for producing a reference code from the analyzed resultant data and the control data;

a reference code input means for providing a specific reference code requested by an operator;

an audio data file generating means for combining the reference code and the audio data file to produced a composite audio data file;

a reference code comparing means for comparing the specific reference code, a newly introduced reference code, or combination of the specific reference code and the newly introduced reference code with the reference code stored in the reference code storing means, the newly introduced reference code being produced by the reference code generating means from other audio signal fed to the sound material input means;

a mode selecting means for switching between a recording mode and a retrieval mode;

a displaying means for displaying a result of the reference code comparing means;

library means for storing the composite audio data file;

a library controlling means for controlling the library means;

an audio data processing means for changing at least one of the physical characteristics of the audio signal to a desired physical characteristic if any of the physical characteristics of the audio signal are unretrieved and outputting the desired physical characteristic; and a reproducing means for reproducing the desired audio data file, wherein in the recording mode, the composite audio data file is stored in the library means and in the retrieval mode, the desired audio data file is retrieved by comparing the specific reference code, the newly introduced reference code, or combination of the specific reference code and the newly introduced reference code with the reference code, and by changing at least one of the physical characteristics of the audio signal to the desired physical characteristic if any of the physical characteristics of the audio signal are unretrieved.

17. An audio data file analyzer apparatus according to claim 16, wherein at least one physical characteristic includes a continuous time duration of the audio signal.

* * * * *